United States Patent [19]

Nakaniwa et al.

[11] Patent Number: 4,951,635

[45] Date of Patent: Aug. 28, 1990

[54] FUEL INJECTION CONTROL SYSTEM FOR INTERNAL COMBUSTION ENGINE WITH COMPENSATION OF OVERSHOOTING IN MONITORING OF ENGINE LOAD

[75] Inventors: Shinpei Nakaniwa; Akihiko Araki; Yukio Hoshino, all of Gunma, Japan

[73] Assignee: Japan Electronic Control Systems Company, Limited, Isezaki, Japan

[21] Appl. No.: 217,861

[22] Filed: Jul. 12, 1988

[30] Foreign Application Priority Data

Jul. 13, 1987 [JP] Japan ..... 62-172963

[51] Int. Cl.[5] ..... F02D 41/10

[52] U.S. Cl. ..... 123/492; 123/488; 123/493

[58] Field of Search ..... 123/492, 493, 488

[56] References Cited

U.S. PATENT DOCUMENTS

| | | | |
|---|---|---|---|
| 4,010,717 | 3/1977 | Taplin | 123/492 |
| 4,408,588 | 10/1983 | Mausner | 123/489 |
| 4,436,072 | 3/1984 | Suzuki et al. | 123/488 |
| 4,481,928 | 11/1984 | Takimoto et al. | 123/492 |
| 4,562,814 | 1/1986 | Abo et al. | 123/492 |
| 4,664,085 | 5/1987 | Kataoka | 123/478 |

FOREIGN PATENT DOCUMENTS

| | | | |
|---|---|---|---|
| 0245117 | 11/1987 | European Pat. Off. . | |
| 2847794 | 5/1979 | Fed. Rep. of Germany . | |
| 3415214 | 10/1985 | Fed. Rep. of Germany . | |
| 60-249651 | 12/1985 | Japan | 123/492 |
| 61-43234 | 3/1986 | Japan . | |
| 2048522 | 12/1980 | United Kingdom . | |
| 2169108 | 7/1986 | United Kingdom . | |

*Primary Examiner*—Andrew M. Dolinar

*Attorney, Agent, or Firm*—Foley & Lardner, Schwartz, Jeffery, Schwaab, Mack, Blumenthal & Evans

[57] ABSTRACT

A fuel injection control system derives a correction coefficient for compensating overshooting component in measurement of an engine load indicative parameter, such as an intake air flow rate. The correction coefficient may be variable in such a manner that it increases according to increasing of the engine load. The correction coefficient may be used for correcting either the measured engine load parameter or the fuel injection amount derived taking the measured engine load.

4 Claims, 9 Drawing Sheets

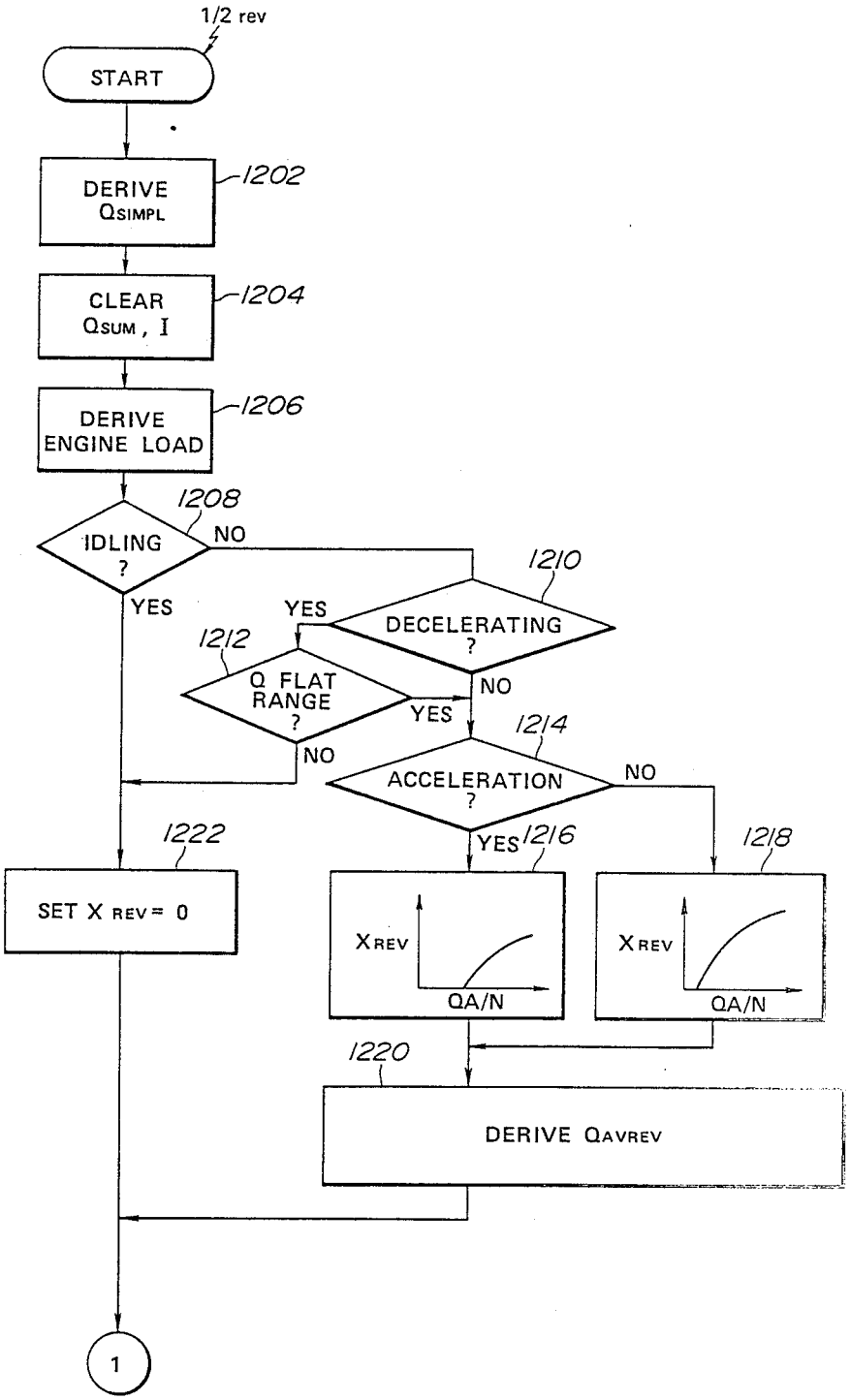
1/2 rev
START
DERIVE QSIMPL
1202
CLEAR QSUM, I
1204
DERIVE ENGINE LOAD
1206
1208
IDLING ?
NO
YES
1210
DECELERATING ?
YES
NO
1212
Q FLAT RANGE ?
YES
NO
1214
ACCELERATION ?
NO
YES
1216
1218
1222
SET X REV = 0
XREV
QA/N
XREV
QA/N
1220
DERIVE QAVREV
1

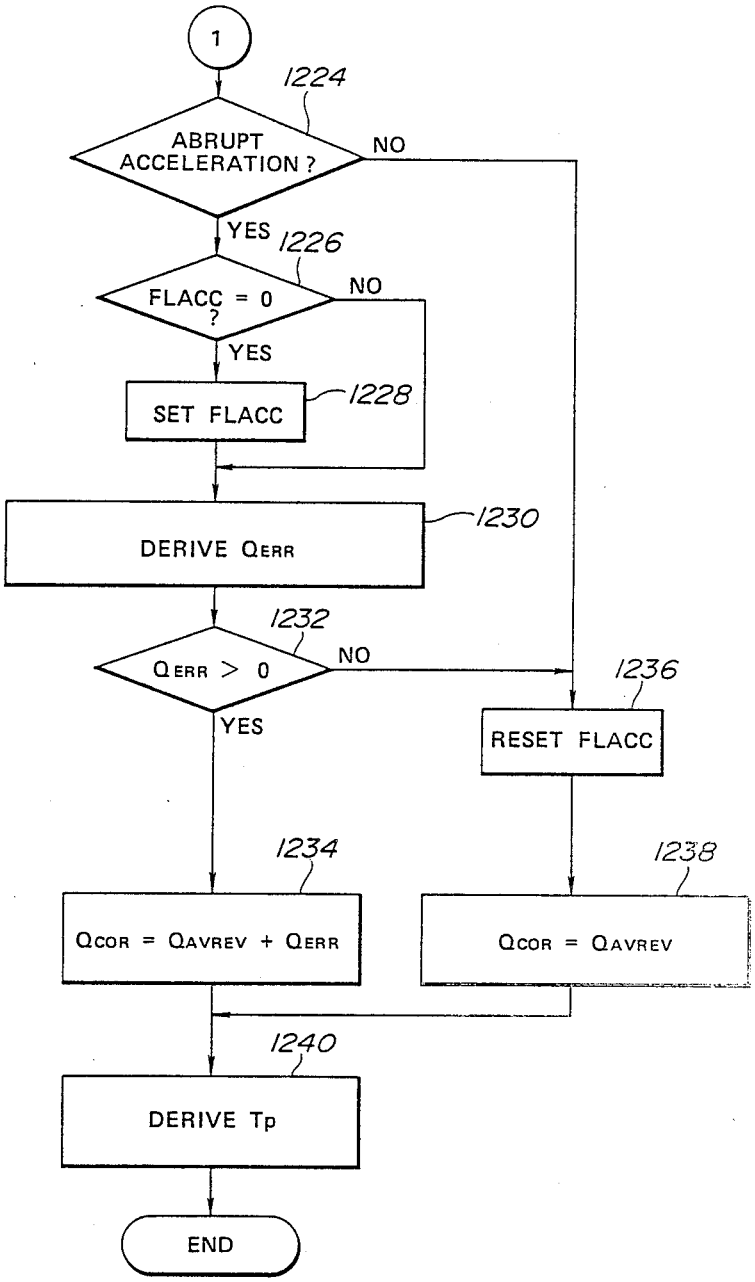
1
1224
ABRUPT ACCELERATION ?
NO
YES
1226
FLACC = 0 ?
NO
YES
SET FLACC
1228
DERIVE QERR
1230
1232
QERR > 0
NO
YES
1236
RESET FLACC
1234
QCOR = QAVREV + QERR
1238
QCOR = QAVREV
1240
DERIVE Tp
END

FUEL INJECTION CONTROL SYSTEM FOR INTERNAL COMBUSTION ENGINE WITH COMPENSATION OF OVERSHOOTING IN MONITORING OF ENGINE LOAD

BACKGROUND OF THE INVENTION

1. Field of the Invention

The present invention relates generally to a fuel injection control system for an internal combustion engine, such as an automotive internal combustion engine. More specifically, the invention relates to a fuel injection control in transition for accelerating the engine. Further particularly, the invention relates precise measurement of engine load upon occurrence of engine acceleration demand.

2. Description of the Background Art

As is well known various types of fuel injection control systems have been developed and proposed in the recent years. The fuel injection controls becomes more and more precise in detection of fuel injection control parameters and higher and higher in responding to variation of the engine driving condition. One of the major task to be achieved by such fuel injection control systems is optimal engine performance in relation to the engine driving condition. Another important task for the fuel injection control systems is anti-pollution emission control.

In the modern fuel injection control systems, acceleration enrichment is performed in response to acceleration demand at high response and at a magnitude precisely corresponding to the magnitude of acceleration demand as measured In general, acceleration demand is detected by detecting a increasing rate of throttle valve open angle. An extra fuel injection amount is usually derived on the basis of extra amount of intake air measured by means of an air flow meter In engine accelerating state, the amount of intake air flow rate measured by the air flow meter tends to become greater than that actually introduced into the engine combustion chamber.

Namely, since the air flow meter is located at upstream of the throttle valve, intake air amount flowing into the collector is measured as extra amount of intake air. Furthermore, further extra amount of intake air due to presence of air induction inertia is measured by the air flow meter. As a result, overshooting occurs in measuring of the intake air flow amount Therefore, when the extra fuel injection amount is derived on the basis of the overshooting intake air flow amount, the fuel amount becomes excessive versus the intake air amount actually introduced into the engine combustion chamber. This establishes over-rich air/fuel mixture to significantly increase pollutant in the exhaust gas.

SUMMARY OF THE INVENTION

Therefore, it is an object of the present invention to provide a fuel injection control system which can eliminating influence of overshooting in measurement of engine load indicative parameter for derivation of fuel injection amount for acceleration enrichment.

In order to accomplish the aforementioned and other objects, a fuel injection control system, according to the present invention, derives a correction coefficient for compensating overshooting component in measurement of an engine load indicative parameter, such as an intake air flow rate. The correction coefficient is variable in such a manner that it increases according to increasing of the engine load.

Practically, correction coefficient is used for correcting either the measured engine load parameter or the fuel injection amount derived taking the measured engine load In the preferred process, the correction for avoiding influence of overshooting in measurement of the engine load, is performed on the measured intake air flow rate, which facilitate better response characteristics in comparison with that correcting the fuel injection amount derived utilizing the measured values.

According to one aspect of the invention, a fuel injection control system for an internal combustion engine comprises an air induction system including a throttle valve for adjusting amount of intake air to be introduced into an engine combustion chamber, a fuel injection valve inserted into the air induction system for injecting controlled amount of fuel, a first sensor means for monitoring an engine speed representing parameter to produce an engine speed indicative first sensor signal, a second sensor means for monitoring an intake air flow rate to produce an intake air flow rate indicative second sensor signal, first means for deriving an engine load indicative data on the basis of the engine speed indicative first sensor signal value and the intake air flow rate indicative second sensor signal value, second means for deriving a first overshooting compensating correction value on the basis of the engine load indicative data, and third means for deriving a fuel injection amount on the basis of preselected fuel injection control parameters including the engine speed indicative first sensor signal, the intake air flow rate indicative second signal and the first overshooting compensating correction value, the third means controlling the fuel injection valve for performing furl injection for injecting the derived fuel injection amount.

The third means derives a basic fuel injection amount on the basis of the engine speed indicative first sensor signal and the intake air flow rate indicative sensor signal, and the third means corrects the basic fuel injection amount by the overshooting compensating correction value. The fuel injection control system may further comprises a fourth means for deriving a second overshooting compensating correction value on the basis of the engine speed data derived on the engine speed indicative first sensor signal, and the third means selectively uses one of the first and second overshooting compensating correction value.

The second means may increase the first overshooting compensating correction value according to increasing of the engine load and the fourth means decreases the second overshooting compensating correction value according to increasing of the engine speed. The third means compares the first and second overshooting compensating correction value to select smaller one for correcting the basic fuel injection amount.

Practically, the third means corrects the intake air flow rate derived from the second sensor signal and derives the basic fuel injection amount on the basis of an engine speed derived based on the first sensor signal and the corrected intake air flow rate.

In the alternative embodiment, the third means includes means for deriving intake air flow rate data on the basis of the second sensor signal, means for periodically sampling the intake air flow rate for obtaining integrated value of the intake air flow rate over a predetermined period of time, means for deriving a first average value on the basis of the integrated value, and means for deriving second average value utilizing the first average value and the overshooting compensating correction value. The third means further comprises means for detecting an engine abrupt accelerating state for deriving a third compensating value on the basis of a difference of the former second average value and the instantaneous second average value, and means for modifying the second average value utilizing the third compensation value.

According to another aspect of the invention, a second embodiment of a fuel injection control system for an internal combustion engine comprises an air induction system including a throttle valve for adjusting amount of intake air to be introduced into an engine combustion chamber, a fuel injection valve inserted into the air induction system for injecting controlled amount of fuel, a first sensor means for monitoring an engine speed representing parameter to produce an engine speed indicative first sensor signal, a second sensor means for monitoring an intake air flow rate to produce an intake air flow rate indicative second sensor signal, first means for deriving an engine load indicative data on the basis of the engine speed indicative first sensor signal value and the intake air flow rate indicative second sensor signal value, second means for deriving a first overshooting compensating correction value on the basis of the engine load indicative data, third means for deriving a basic fuel injection amount on the basis of the engine speed indicative first sensor signal and the intake air flow rate indicative second signal, fourth means for correcting the fuel injection value based on preselected correction factors and based on the first overshooting compensating correction value, and fifth means for controlling the fuel injection valve for performing fuel injection for injecting the derived fuel injection amount.

According to a further aspect of the invention, a fuel injection control system for an internal combustion engine comprises an air induction system including a throttle valve for adjusting amount of intake air to be introduced into an engine combustion chamber, a fuel injection valve inserted into the air induction system for injecting controlled amount of fuel, first means for monitoring an engine speed representing parameter to produce an engine speed indicative data, second sensor means for monitoring an intake air flow rate to produce an intake air flow rate indicative data, third means for deriving an engine load indicative data on the basis of the engine speed indicative first sensor signal value and the intake air flow rate indicative second sensor signal value, fourth means for deriving a first overshooting compensating correction value on the basis of the engine load indicative data, fifth means for correcting the intake air flow rate indicative data utilizing the first overshooting compensating correction value, sixth means for deriving a basic fuel injection amount on the basis of the engine speed indicative data and the corrected intake air flow rate indicative data, seventh means for correcting the fuel injection value based on preselected correction factors, and eighth means for controlling the fuel injection valve for performing fuel injection for injecting the derived fuel injection amount.

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiment but are for explanation and understanding only.

In the drawings:

FIGS. 9*a* and 9*b* are flowchart showing another embodiment of a basic fuel injection amount derivation routine with correction of intake air flow rate data Q, which routine is executed in engine revolution synchronous manner.

DESCRIPTION OF THE PREFERRED EMBODIMENT

Figure 1:
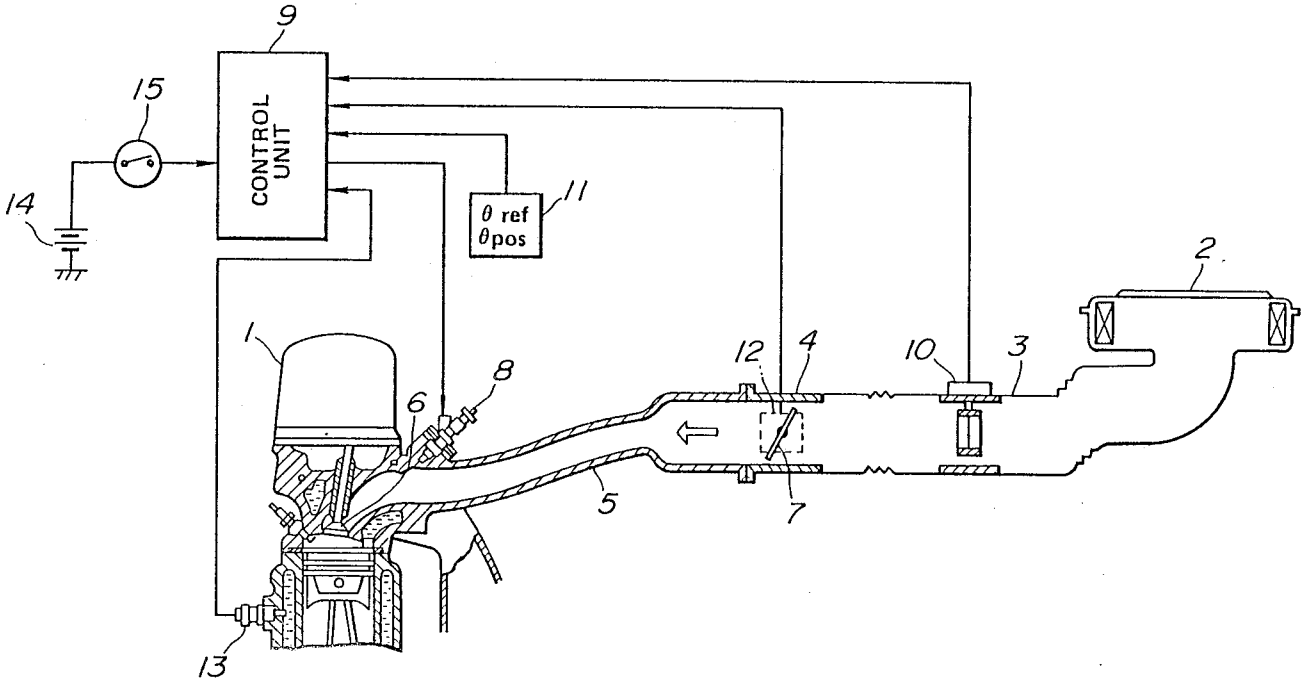
FIG. 1 is a diagramatical illustration of a fuel injection internal combustion engine, to which the preferred embodiment of a fuel injection control system according to the present invention is applied.
Figure 2:
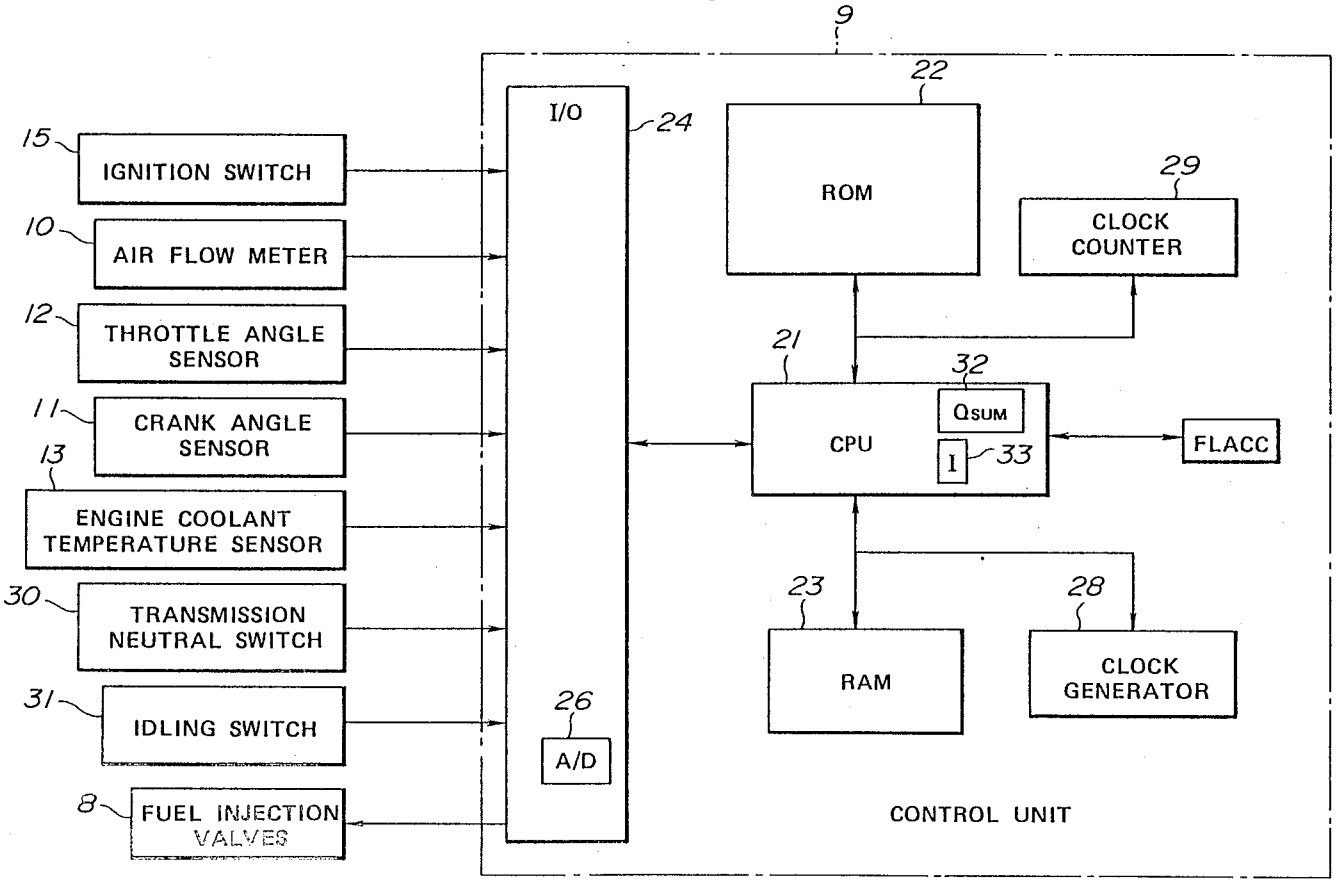
FIG. 2 is a block diagram of the preferred embodiment of the fuel injection control system of the invention.

Referring now to the drawings, particularly to FIGS. 1 and 2, the preferred embodiment of a fuel injection control system, according to the present invention, is specifically adapted for so-called a sequential injection type fuel injection system for an internal combustion engine 1 which is designed for injecting a controlled amount of fuel for each cylinder near or at an induction TDC independently to that for other cylinders. The engine 1 has an air induction system including an air cleaner 2, an induction pipe 3, a throttle chamber 4, an intake manifold 5 and an intake port operably closed by means of an intake valve 6. A throttle valve 7 is disposed within the throttle chamber 4 to adjust air flow path area depending upon operation magnitude of an accelerator pedal (not shown).

A plurality of fuel injection valves 8 (only one is shown) is provided for injecting fuel into the air induction system for forming an air/fuel mixture to be combustioned in combustion chambers defined in each engine cylinder In order to perform fuel injection for each engine cylinder independently of that for other cylinders, each fuel injection valve 8 is directed to corresponding one of branch passage of the intake manifold 5. The fuel injection valve 8 incorporates an electromagnetic actuator 8*a* for driving the fuel injection valve between open and closed positions. Namely, as is well known, the electromagnetic actuator 8*a* is responsive to a HIGH level fuel injection pulse to open for injecting fuel and to close while the fuel injection pulse is held LOW level. The open period of the fuel injection valve 8 is thus determined according to the duration of the HIGH level fuel injection pulse.

In order to determine the fuel injection pulse duration depending on the engine driving condition and to send the fuel injection pulse to each of the electromagnetic actuator 8a at an appropriate timing, a microprocesser based control unit 9 is provided in the fuel injection control system. The control unit 9 is connected to an air flow meter 10 to received therefrom an air flow rate indicative signal which is indicative of an air flow rate Q representative of the engine load condition. In the shown embodiment, the air flow meter 10 comprises a hot wire type air flow meter.

The control unit 9 is also connected to a crank angle sensor 11 which is built-in a distributor (not shown) in a spark ignition system of the engine. In the alternative, the crank angle sensor may be directly associated with a crank shaft for monitoring the rotational angular position thereof. The crank angle sensor 11 is designed to output a crank reference signal at every predetermined angular position, e.g. 70° before TDC (70° BTDC) of each engine cylinders, and a crank position signal at every given angular displacement of the crank shaft, e.g. 1° of 2°. Furthermore, in the preferred construction, the crank angle sensor 11 is so designed as to output the crank reference signal indicative of 70 BTDC of specific one of engine cylinder, e.g. No. 1 cylinder.

The control unit 9 is further connected to a throttle angle sensor 12 which is associated with a throttle valve 7 for monitoring angular position of the latter to produce a throttle angle indicative signal $\theta_{th}$. This throttle angle indicative signal $\theta$ essentially represents acceleration and deceleration demand input through the accelerator pedal by the driver. In addition, the control unit 9 is connected to an engine coolant temperature sensor 13 disposed within an engine cooling chamber to monitor the temperature condition of the engine coolant to produce an engine coolant temperature indicative signal Tw. Furthermore, the control unit 9 is connected to a vehicular battery 14 via an ignition switch 15 which serves as a main power supply switch.

As particularly shown in FIG. 2, the control unit 9 generally comprises a microprocessor 20 including CPU 21, ROM 22, RAM 23, and an input/output unit 24. The input/output unit 24 incorporates an analog-to-digital (A/D) converter 26 for converting the analog form sensor signals from the air flow meter 10, the throttle angle sensor 12 and the engine coolant temperature sensor 13, into digital signals to be processed by the microprocessor.

As seen from FIG. 2, the microprocessor 20 incorporates an internal or external clock generator 28 for outputting clock pulses Also, the microprocessor 20 has a clock counter 29 for counting up the clock pulses for measuring elapsed period of time. This counter value of the clock counter 29 may be used as time indicative data for triggering time based interrupt program, such as 10 ms interrupt program which will be discussed later. Also, the counter value of the clock counter 29 may be utilized as elapsed time indicative data for derivation of the engine speed data N.

The process of fuel injection control to be performed by the foregoing preferred embodiment of the fuel injection control system will be discussed herebelow with reference to FIGS. 3 to 9.

Figure 3:
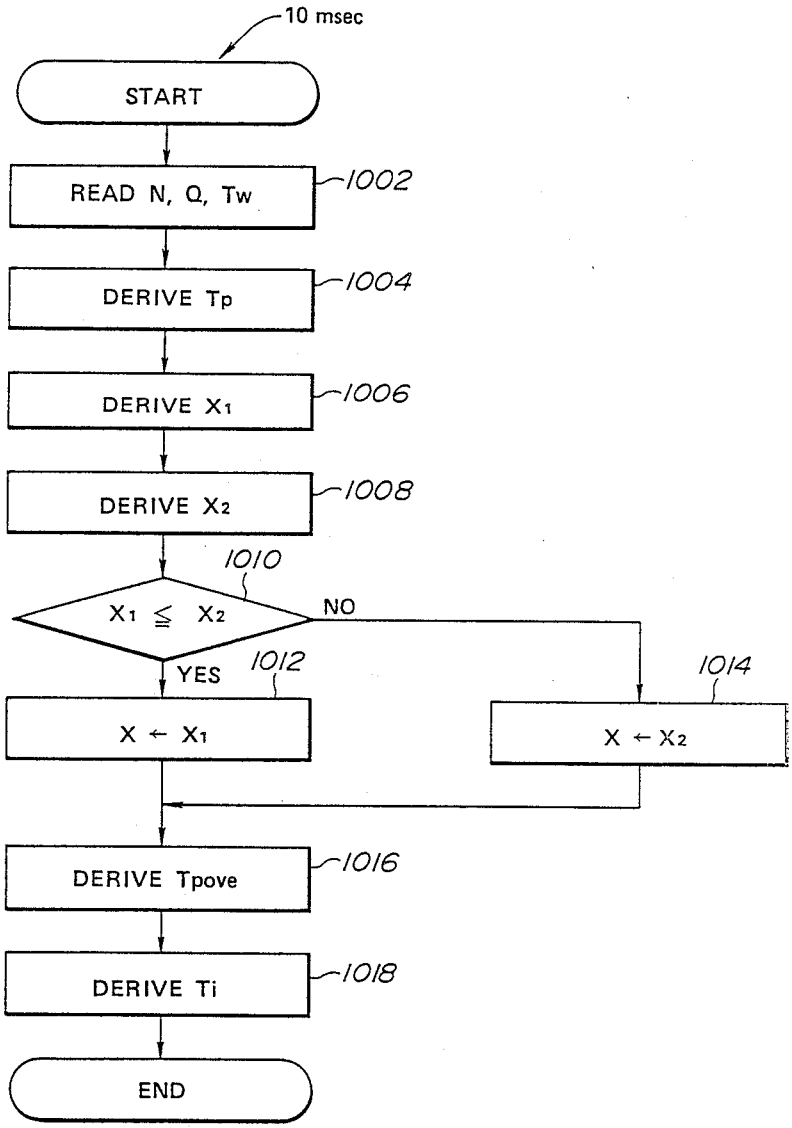
FIG. 3 is a flowchart of a fuel injection amount derivation routine to be executed in time synchronous manner.

FIG. 3 shows a flowchart of fuel injection amount deriving routine which is triggered every 10 ms. The shown routine is designed for periodically updating fuel injection amount data for precisely adjusting fuel injection amount depending upon the engine driving condition.

Immediately after starting execution, preselected fuel injection control parameters, such as the engine speed indicative data N, the intake air flow rate indicative data Q, the engine coolant temperature indicative data Tw and so forth, at a step 1002. Based on the engine speed indicative data N and the intake air flow rate indicative data Q, read at the step 1002, a basic fuel injection amount Tp is derived by the following known equation, at a step 1004:

$$Tp = K \times Q/N \text{ (K: constant)}$$

In the shown embodiment, the basic fuel injection amount Tp is taken as an engine load indicative data.

Figure 4:
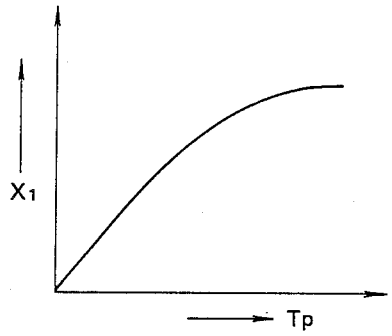
FIG. 4 is a chart showing relationship between an engine load dependent correction value $X_1$ and an engine load indicative data Tp.
Figure 5:
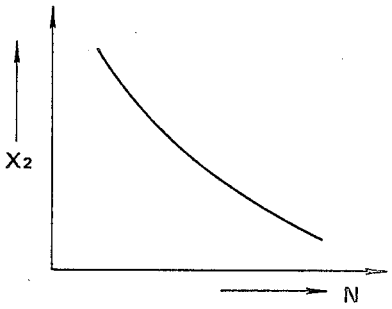
FIG. 5 is a chart showing relationship between an engine speed dependent correction value $X_2$ and an engine speed indicative data N.
Figure 6:
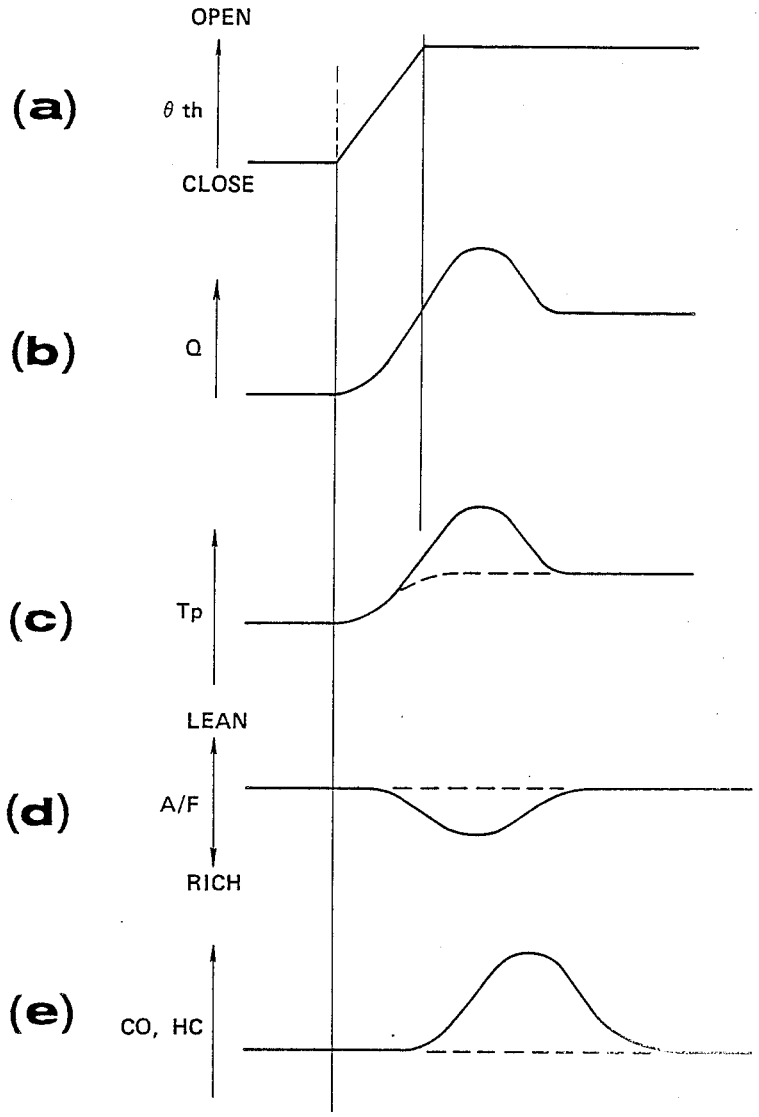
FIG. 6 is a timing chart showing variation of a throttle valve angle $\theta_{th}$, an intake air flow rate Q, a basic fuel injection amount Tp, an air/fuel ratio and amount of CO and HC in an exhaust gas during acceleration transition.

At a step 1006, an engine load dependent weight value $X_1$ is derived on the basis of the basic fuel injection amount Tp as the engine load indicative data. In practice, the engine load dependent weight value $X_1$ is set in a form of a map in ROM 22. As shown in FIG. 4, the weight value $X_1$ is set to increase the value for weighting according to increase of the engine load indicative data. At a step 1008, an engine speed dependent weight value $X_2$ is derived on the basis of the basic the engine speed indicative data N In practice, the engine speed dependent weight value $X_2$ set in a form of a map in ROM 22. As shown in FIG. 4, the weight value $X_2$ is set to decrease the value for weighting according to increase of the engine speed indicative data N.

The engine load dependent weight value $X_1$ and the engine speed dependent weight value $X_2$ derived at the steps 1006 and 1008 are compared with each other, at a step 1010. When the engine load dependent weight value $X_1$ is smaller than or equal to the engine speed dependent weight value $X_2$, an overshooting compensating correction value X is set at a value corresponding to the engine load dependent weight function $X_1$, at a step 1012. On the other hand, when the engine load dependent weight function $X_1$ is greater than the engine speed dependent weight function $X_2$, the overshooting compensating correction value X is set at a value corresponding to the engine speed dependent weight value $X_2$, at a step 1014.

After setting the overshooting compensating correction value X either at the step 1012 or 1014, weighting operation for the basic fuel injection amount Tp is performed at a step 1016. Weighting is performed for deriving fuel injection amount Tpave to be utilized for deriving a fuel injection amount Ti, by the following equation:

$$Tpave = \{Tpave'(s^X - 1) + T_{PN}\}/2^X$$

where Tpave' is basic fuel injection amount derived immediately preceding cycle; and $T_{PN}$ is the basic fuel injection amount derived at the step 1004 in the current execution cycle.

Utilizing the basic fuel injection amount Tpave derived at the step 1016, the fuel injection amount Ti is derived at a step 1018. Practically, the fuel injection amount Ti is derived through the following known equation:

$$Ti = Tpave \times K_{LAMBDA} \times COEF + TS$$

where $K_{LAMBDA}$ is air/fuel ratio dependent correction coefficient which is derived on the basis of an oxygen concentration indicative data as measured by means of an oxygen sensor disposed within an exhaust passage;

COEF is a correction coefficient including an acceleration enrichment correction factor, a cold engine enrichment correction factor, engine start-up correction factor and so forth; and Ts is a battery voltage dependent correction value.

In the process of derivation of the fuel injection amount Ti set forth above, the basic fuel injection amount Tpave derived through the weighting process varies mainly depending upon the instantaneous basic fuel injection value Tp derived at the step 1002 in the current execution cycle at initial stage of engine acceleration. Namely, at the initial stage of engine acceleration, the engine load is still maintained at relatively small value. Therefore, the engine load dependent weight value $X_1$ derived in the current execution cycle is maintained at relatively small value. As a result, the engine load indicative data to be used for deriving the fuel injection amount Ti is substantially correspond to that measured by the air flow meter. This achieves satisfactorily high response characteristics for good acceleration performance and exhaust characteristics.

On the other hand, in the range near the end of acceleration, the engine load reaches great value to make the engine load dependent weight value $X_1$ substantially great. Therefore, dependency on the basic fuel injection amount Tpave derived in the former execution cycle becomes greater to avoid or reduce influence of overshooting in measurement of the intake air flow rate, as shown by broken line in FIG. 6c. By this, the air/fuel ratio can be maintained near stoichiometric value even in acceleration transition and avoid the air/fuel ratio falling into over-rich condition. Therefore, as illustrated by broken line in FIG. 6e, amount of CO and HC in the exhaust gas can be maintained at substantially normally value.

Furthermore, in accordance with the shown embodiment, since the overshooting compensating correction value X is derived by smaller one of the engine load dependent weight value $X_1$ and the engine speed dependent weight value $X_2$, the overshooting compensating correction value X is held at substantially small value while the engine is in substantially high speed range for magnitude of influence of weighting substantially small Therefore, in the high engine speed range, the basic fuel injection amount Tpave to be used for deriving the fuel injection amount Ti can substantially correspond to that derived on the basis of the measured engine speed N and the intake air flow rate Q.

Though the foregoing process utilizing the equation discussed with respect to the step 1016, the following equation is also useful for deriving the basic fuel injection amount Tpave:

$$Tpave = \{Tp_N \times (256 - X) + Tpave' \times X\}/256$$

Figure 7:
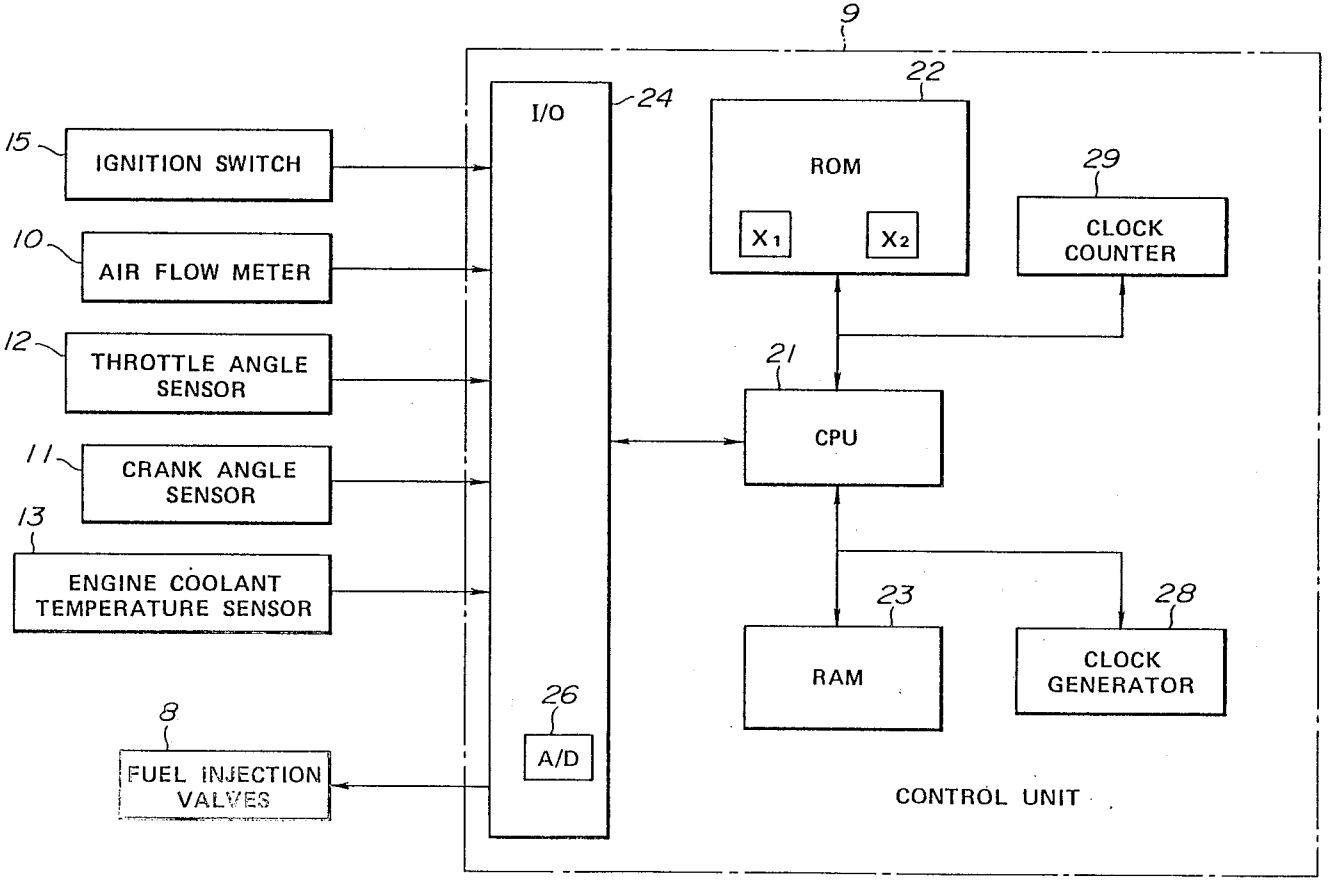
FIG. 7 is a block diagram of another preferred embodiment of the fuel injection control system of the invention.

FIG. 7 is a block diagram of another embodiment of the fuel injection control system according to the present invention. The shown embodiment of the fuel injection control system is designed for a single-point injection type fuel injection internal combustion engine, which performs fuel injection once each engine cycle, i.e. two engine revolution cycles. Therefore, the control unit 9 is connected to a single fuel injection valve 8. The components constituting the shown embodiment of the fuel injection control system, which are common to the former embodiment will be prepresenting by the same reference numerals and will be neglected In addition to the sensors employed in the former embodiment, a transmission neutral position switch 30 which is designed to detect neutral position of a power transmission to produce HIGH level transmission neutral position indicative signal $Tr_N$. Also, the shown embodiment of the fuel injection control system includes an idling switch 31 associated with the throttle valve 7 to detect fully closed position of the latter. The idling switch 31 produces an engine idling indicative signal IDL.

It should be noted that though the shown embodiment is designed for controlling fuel injection amount in the single-point fuel injection system and therefore the process of single-point fuel injection control which will be discussed later, the similar process may be applicable for a multi-point fuel injection control.

Figure 8:
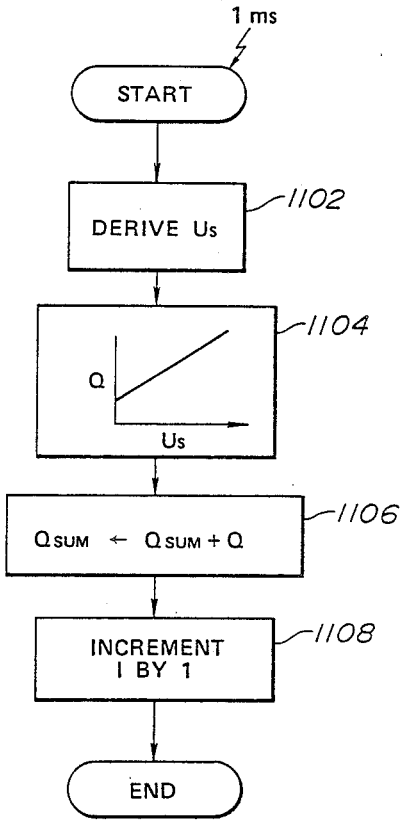
FIG. 8 is a flowchart of a time synchronous intake air flow ratio indicative data Q sampling routine.

FIG. 8 shows a routine for sampling intake air flow rate Q over half of engine cycle. The routine of FIG. 8 is triggered every 1 ms for sampling instantaneous intake air flow rate indicative data Q.

Immediately after starting execution, the intake air flow rate indicative signal $S_Q$ of the air flow meter 10, is A/D converted to derive digital value Us corresponding to the intake air flow rate indicative signal value, at a step 1102. Based on the digital value Us, the intake air flow rate indicative data Q, at a step 1104. In practice, the intake air flow rate indicative data Q is derived by utilizing a map established in ROM 22.

At a step 1106, a temporary register 32 in CPU 21 is accessed to read out an integrated value $Q_{SUM}$ which is integrated value of the intake air flow rate indicative data Q every execution cycle and is reset during later-mentioned fuel injection amount derivation routine of FIGS. 9a and 9b. The intake air flow rate indicative data Q derived at the step 1104 is added to the integrated value $Q_{SUM}$. The updated integrated value $Q_{SUM}$ is them stored in the temporary register 32 of CPU 21. At a step 1108, a counter value I of a cycle counter 33 in CPU 21 is incremented. The counter value I serves as time indicative data.

FIGS. 9a and 9b shows another process of deriving the basic fuel injection amount Tp. In this process, overshooting compensation in measurement of air flow rate is performed for the intake air flow rate indicative data Q.

The shown routine is triggered at every half engine cycles, i.e. every engine revolution cycles.

Immediately after starting execution, a simple average value $Q_{SIMPL}$ is derived by dividing the integrated value $Q_{SUM}$ by the counter value I, at a step 1202. Thereafter, the counter value I and the integrated value $Q_{SUM}$ are cleared at a step 1204.

At a step 1206, an engine load indicative data is derived by dividing the intake air flow rate data Q by the engine speed data N. The engine load data thus derived is to be used for deriving overshooting compensation through the below-mentioned processes.

Though the shown embodiment utilizes the intake air flow rate indicative data as a raw data, it is possible to use the simple average value $Q_{SIMPL}$ as the intake air flow rate indicative data for deriving the engine load indicative data.

At a step 1208, check is performed whether the engine is in idling condition or not. In order to check the engine idling condition, the idling condition indicative signal IDL and the transmission neutral position indicative signal $Tr_N$ are checked. Namely, judgement is made that the engine is in idling condition when both of the idling condition indicative signal IDL and the transmission neutral position indicative signal $Tr_N$ are HIGH level.

When the engine is not in idling condition as checked at the step 1208, check is performed whether the engine is in decelerating state, at a step 1210. Check of engine deceleration state is performed by monitoring variation rate of the throttle angle $\theta_{th}$. For this, variation magnitude of throttle angle $\theta_{th}$ over 30 ms is derived and compared with a predetermined deceleration criterion. In the shown embodiment, the deceleration criterion is set at a value of $-1.6°/30$ ms.

When the engine deceleration state is detected at the step 1210, the engine driving range is checked at a step 212. In the certain engine driving range, the intake air flow rate Q is maintained substantially constant irrespective of the throttle valve angular position. Namely, at substantially high engine load range, the intake air flow rate Q becomes irrespective of the throttle angle position The engine driving range where the intake air flow rate is maintained constant irrespective of the throttle angle position will be hereafter referred to as "Q flat range". When the engine in the Q flat range is detected as checked at the step 1212 or when the engine is not in the decelerating state as checked at the step 1210, Check is performed whether the engine is in accelerating state at a step 1214. When the process moves to the step 1214 via the step 1212, the engine is not in the accelerating state. However, in the process at the step 1214, throttle angle variation rate is checked to detect the engine accelerating state. The throttle angular variation over a predetermined period, e.g. 100 ms. is compared with a predetermined value 1.6°.

After the step 1214, process goes a to steps 1216 and 1218 for deriving weight value $X_{REV}$. When the engine accelerating state is detected as checked at the step 1214, first weight value table $X_{REV}1$ set in ROM 22 is used and looked up in terms of the engine load indicative data (Q/N) for deriving the weight value $X_{REV}$, at a step 1216. On the other hand, when the engine is not in the accelerating state as checked at the step 1214, a second weight value table $X_{REV}2$ set in ROM 22 is used and looked up in terms of the engine load indicative data (Q/N) for deriving the weight value $X_{REV}$ at a step 1218.

Then, at a step 1220, the weighted intake air flow rate indicative data $Q_{AVREV}$ is derived by the following equation:

$$Q_{AVREV}=\{Q_{SIMPL}\times(256-X_{REV})+Q_{AVREV}'\times X_{REV}\}/256$$

where $Q_{AVREV}'$ is weighted intake air flow rate indicative data derived in immediately preceding execution cycle.

On the other hand, when the engine is in idling state as checked at the step 1208 or when the engine driving range is out of the Q flat range as checked at the step 1212, the weight value $X_{REV}$ is set zero, at a step 1222. Furthermore, the simple average value $Q_{SIMPL}$ is set as the weighted intake air flow rate indicative data $Q_{AVREV}$ at the step 1222.

At a step 1224, check is performed whether the engine is abrupt acceleration state or not. Abrupt engine acceleration state is checked by checking the throttle angle variation rate. In practice, the throttle angle variation over a predetermined period, e.g. 30 ms. is compared with the predetermined value 1.6°. When abrupt acceleration is detected at the step 1224, an abrupt acceleration indicative flag FLACC is checked at a step 1226. When abrupt acceleration indicative flag FLACC is not set as checked at the step 1226, process goes to a step 1228 to set the flag FLACC. After setting the abrupt acceleration indicative flag FLACC or when the abrupt acceleration indicative flag as checked at the step 1224 is already set, an intake air flow rate variation indicative value is calculated at a step 1230. Practically, the intake air flow rate variation indicative value $Q_{ERR}$ is calculated by:

$$Q_{ERR}=(Q_{AVREV}-Q_{AVREV}')\times K_{MANI}$$

wherein $K_{MANI}$ is a constant value derived on the basis of collector volume of intake manifold and response characteristics of the air flow meter and normally set approximately 2.6.

At a step 1232, the intake air flow rate variation indicative value $Q_{ERR}$ is checked whether it is greater than zero or not. When the air flow rate variation indicative value $Q_{ERR}$ is greater than zero, a corrected intake air flow rate $Q_{COR}$ is derived by adding the intake air flow rate variation indicative value $Q_{ERR}$ to the weighted intake air flow rate indicative data $Q_{AVREV}$ at a step 1234.

On the other hand, when the engine is not in abrupt acceleration state as checked at the step 1224 and when the intake air flow rate variation indicative value $Q_{ERR}$, the abrupt acceleration indicative flag FLACC is reset at a step 1236. Then, the weighted intake air flow rate indicative data $Q_{AVREV}$ is set as the corrected intake air flow rate data $Q_{COR}$, at a step 1238.

After the step 1234 and 1238, the basic fuel injection amount Tp is derived by:

$$Tp=K\times Q_{COR}/N$$

at a step 1240.

With the foregoing process, simply averaged intake air flow rate $Q_{SIMPL}$ and the weighted intake air flow rate indicative data $Q_{AVREV}$ are used in combination. This is advantageously introduced since the relative interval between derivation of the weighted intake air flow rate is long in the engine speed range where influence of the overshooting in measurement of the intake air flow rate is significant, abrupt variation of the intake air flow rate due to overshooting can be successfully suppressed. This improves air/fuel ratio control characteristics and exhibits good anti-polusion effect.

In comparison with the former embodiment, this second embodiment is advantageous because of higher response characteristics and better emission control performance.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

What is claimed is:

1. A fuel injection control system for an internal combustion engine comprising:

an air induction system including a throttle valve for adjusting an amount of intake air to be introduced into an engine combustion chamber;

a fuel injection valve inserted into said air induction system for injecting a controlled amount of fuel;

first sensor means for monitoring an engine speed representing parameter to produce an engine speed indicative first sensor signal;

second sensor means for monitoring an intake air flow rate to produce an intake air flow rate indicative second sensor signal;

first means for deriving engine load indicative data on the basis of said engine speed indicative first sensor signal value and said intake air flow rate indicative second sensor signal value;

second means for deriving a first overshooting compensating correction value on the basis of said engine load indicative data;

third means for deriving a fuel injection amount on the basis of preselected fuel injection control parameters including said engine speed indicative first sensor signal, said intake air flow rate indicative second signal and said first overshooting compensating correction value, said third means controlling said fuel injection valve for performing fuel injection for injecting a derived fuel injection amount, said third means deriving a basic fuel injection amount on the basis of said engine speed indicative first sensor signal and said intake air flow rate indicative sensor signal, and said third means correcting said basic fuel injection amount by said overshooting compensating correction value; and fourth means for deriving a second overshooting compensating correction value on the basis of said engine speed data derived on said engine speed indicative first sensor signal, said third means selectively using one of said first and second overshooting compensating correction values;

said second means increasing said first overshooting compensating correction value according to increasing of said engine load; and said fourth means decreasing said second overshooting compensating correction value according to increasing engine speed.

2. A fuel injection control system as set forth in claim 1, wherein said third means compares said first and second overshooting compensating correction value to select smaller one for correcting said basic fuel injection amount.

3. A fuel injection control system for an internal combustion engine comprising:

an air induction system including a throttle valve for adjusting an amount of intake air to be introduced into an engine combustion chamber;

a fuel injection valve inserted into said air induction system for injecting a controlled amount of fuel;

first sensor means for monitoring an engine speed representing parameter to produce an engine speed indicative first sensor signal;

second sensor means for monitoring an intake air flow rate to produce an intake air flow rate indicative second sensor signal;

first means for deriving engine load indicative data on the basis of said engine speed indicative first sensor signal value and said intake air flow rate indicative second sensor signal value;

second means for deriving a first overshooting compensating correction value on the basis of said engine load indicative data;

third means for deriving a basic fuel injection amount on the basis of said engine speed indicative first sensor signal and said intake air flow rate indicative second signal;

fourth means for correcting said fuel injection value based on preselected correction factors and based on said first overshooting compensating correction value;

fifth means for controlling said fuel injection valve for performing fuel injection for injecting a derived fuel injection amount; and sixth means for deriving a second overshooting compensating correction value on the basis of said engine speed data derived on said engine speed indicative first sensor signal, said fourth means selectively using one of said first and second overshooting compensating correction values, said second means increasing said first overshooting compensating correction value according to increasing of said engine load and said sixth means decreasing said second overshooting compensating correction value according to increasing of engine speed.

4. A fuel injection control system as set forth in claim 3, wherein said fourth means compares said first and second overshooting compensating correction value to select smaller one for correcting said basic fuel injection amount.

* * * * *